US006202388B1

(12) United States Patent
Sanfilippo et al.

(10) Patent No.: US 6,202,388 B1
(45) Date of Patent: Mar. 20, 2001

(54) CONTROLLED ENVIRONMENT SEALING APPARATUS AND METHOD

(75) Inventors: James J. Sanfilippo, Chicago; John E. Sanfilippo, Barrington, both of IL (US)

(73) Assignee: Jescorp, Inc., Des Plaines, IL (US)

( * ) Notice: Subject to any disclaimer, the term of this patent is extended or adjusted under 35 U.S.C. 154(b) by 0 days.

(21) Appl. No.: 09/186,930

(22) Filed: Nov. 6, 1998

(51) Int. Cl.[7] ..... B65B 31/04
(52) U.S. Cl. ..... 53/432; 53/510
(58) Field of Search ..... 53/478, 510, 329.3, 53/329.5, 432

(56) References Cited

U.S. PATENT DOCUMENTS

| | | |
|---|---|---|
| 268,477 | 12/1882 | Fish . |
| 789,699 | 5/1905 | Lorenz . |
| 1,406,380 | 2/1922 | Heath et al. . |
| 1,639,828 | 8/1927 | Wheeler et al. . |
| 1,928,903 | 10/1933 | Manning . |
| 1,940,013 | 12/1933 | Petersen . |
| 2,131,876 | 10/1938 | Hurst . |
| 2,140,187 | 12/1938 | Kantor . |
| 2,199,565 | 5/1940 | Kantor . |
| 2,227,190 | 12/1940 | Kronquest . |
| 2,240,655 | 5/1941 | Kronquest . |
| 2,362,799 | 11/1944 | Boyd et al. . |
| 2,439,773 | 4/1948 | Hohl et al. . |
| 2,519,353 | 8/1950 | Cassady . |
| 2,521,746 | 9/1950 | Preis . |
| 2,534,305 | 12/1950 | Sharf . |
| 2,630,958 | 3/1953 | Hohl . |
| 2,649,671 | 8/1953 | Bartelt . |
| 2,660,352 | 11/1953 | Renard . |
| 2,768,487 | 10/1956 | Day et al. . |
| 2,978,336 | 4/1961 | Morrison . |
| 3,026,656 | 3/1962 | Rumsey, Jr. . |
| 3,056,244 | 10/1962 | Bartels . |
| 3,087,823 | 4/1963 | Hein et al. . |
| 3,103,771 | 9/1963 | Gräfingholt . |
| 3,117,873 | 1/1964 | Bartels et al. . |
| 3,220,153 | 11/1965 | Cormack, Jr. et al. . |
| 3,220,157 | 11/1965 | Buchner . |
| 3,340,668 | 9/1967 | Bofinger . |
| 3,343,332 | 9/1967 | Mahaffy et al. . |
| 3,347,534 | 10/1967 | Dawson . |
| 3,415,310 | 12/1968 | Kulhmann . |
| 3,466,841 | 9/1969 | Rausing . |

(List continued on next page.)

FOREIGN PATENT DOCUMENTS

| | | |
|---|---|---|
| 671525 | 12/1996 | (AU) . |
| 689718 | 7/1998 | (AU) . |
| 447131 | 3/1948 | (CA) . |
| 463300 | 2/1950 | (CA) . |
| 1309992 | 9/1989 | (CA) . |
| 33 23 710 A1 | 10/1985 | (DE) . |
| 0 806 354 A1 | 7/1996 | (EP) . |
| 0 806 355 A1 | 5/1997 | (EP) . |
| 0139313 | 5/1990 | (JP) . |
| WO 95/31375 | 11/1995 | (WO) . |
| WO 96/24470 | 8/1996 | (WO) . |

*Primary Examiner*—Scott A. Smith
*Assistant Examiner*—John Paradiso
(74) *Attorney, Agent, or Firm*—Cardinal Law Group

(57) ABSTRACT

A controlled environment sealing apparatus includes a reciprocating seal head positioned above an intermittent conveyer carrying product-filled trays, a film feeder to dispense film between the tray and reciprocating seal head, and at least one seal head gassing assembly positioned in the seal head and oriented to direct a flow of controlled environment gas through a cut-out portion of the film into a product-filled tray positioned beneath the seal head. The seal head gassing assembly may preferably direct a high velocity controlled environment gas stream surrounded by a lower velocity controlled environment gas stream downward into the tray.

21 Claims, 5 Drawing Sheets

U.S. PATENT DOCUMENTS

| | | | |
|---|---|---|---|
| 3,486,295 | 12/1969 | Rausing et al. . | |
| 3,488,915 | 1/1970 | Delestatius . | |
| 3,508,373 | 4/1970 | Robinson, Jr. . | |
| 3,511,022 | 5/1970 | Finley et al. . | |
| 3,545,160 | 12/1970 | Jantze et al. . | |
| 3,556,174 | 1/1971 | Gibble et al. . | |
| 3,584,661 | 6/1971 | Riesenberg . | |
| 3,619,975 | 11/1971 | Johnson et al. . | |
| 3,673,760 | 7/1972 | Canamero et al. . | |
| 3,676,673 | 7/1972 | Coleman . | |
| 3,708,952 | 1/1973 | Schulze . | |
| 3,747,296 | 7/1973 | Zausner . | |
| 3,807,052 | 4/1974 | Troue . | |
| 3,837,137 | 9/1974 | Yatsushiro et al. . | |
| 3,860,047 | 1/1975 | Finkelmeier et al. . | |
| 3,861,116 | 1/1975 | Domke . | |
| 3,871,157 | 3/1975 | Domke et al. . | |
| 3,881,300 | 5/1975 | Zetterberg . | |
| 3,910,009 | 10/1975 | Canfield . | |
| 3,936,950 | 2/1976 | Troue . | |
| 3,939,287 | 2/1976 | Orwig et al. . | |
| 3,942,301 | 3/1976 | Domke . | |
| 4,014,153 | 3/1977 | Wilson . | |
| 4,014,158 | 3/1977 | Rausing . | |
| 4,016,705 | 4/1977 | Wilson et al. . | |
| 4,027,450 | 6/1977 | Chiu et al. . | |
| 4,094,121 | 6/1978 | Ganholt . | |
| 4,140,159 | 2/1979 | Domke . | |
| 4,148,933 | 4/1979 | Janovtchik . | |
| 4,154,044 | 5/1979 | Lang . | |
| 4,409,252 | 10/1983 | Buschkens et al. . | |
| 4,458,734 | 7/1984 | Scholle et al. . | |
| 4,498,508 | 2/1985 | Scholle et al. . | |
| 4,588,000 | 5/1986 | Malin et al. . | |
| 4,602,473 | 7/1986 | Hayashi et al. . | |
| 4,624,099 | 11/1986 | Harder . | |
| 4,625,498 | 12/1986 | Parsons | 53/329.5 |
| 4,658,566 | 4/1987 | Sanfilippo . | |
| 4,685,274 | 8/1987 | Garwood . | |
| 4,696,226 | 9/1987 | Witmer . | |
| 4,703,609 | 11/1987 | Yoshida et al. . | |
| 4,733,818 | 3/1988 | Aghnides . | |
| 4,768,326 | 9/1988 | Kovacs . | |
| 4,791,775 | 12/1988 | Raque et al. . | |
| 4,823,680 | 4/1989 | Nowotarski . | |
| 4,827,696 | 5/1989 | Arends et al. . | |
| 4,831,811 | 5/1989 | Nixon, Jr. et al. . | |
| 4,870,800 | 10/1989 | Kasai . | |
| 4,905,454 | 3/1990 | Sanfilippo et al. . | |
| 4,941,306 | 7/1990 | Pfaffman et al. . | |
| 4,962,777 | 10/1990 | Bell . | |
| 4,964,259 | 10/1990 | Yivisaker et al. . | |
| 4,982,555 | 1/1991 | Ingemann . | |
| 4,996,071 | 2/1991 | Bell . | |
| 5,001,878 | 3/1991 | Sanfilippo et al. . | |
| 5,020,303 | 6/1991 | Vokins . | |
| 5,025,611 | 6/1991 | Garwood . | |
| 5,054,265 | 10/1991 | Perigo et al. . | |
| 5,069,020 | 12/1991 | Sanfilippo et al. . | |
| 5,071,667 | 12/1991 | Grüne et al. . | |
| 5,077,954 | 1/1992 | Williams . | |
| 5,121,590 | 6/1992 | Scanlan . | |
| 5,155,971 | 10/1992 | Zopf . | |
| 5,159,799 | 11/1992 | Rising et al. . | |
| 5,178,841 | 1/1993 | Vokins et al. . | |
| 5,201,165 | 4/1993 | Marano et al. . | |
| 5,228,269 | 7/1993 | Sanfilippo et al. . | |
| 5,230,203 | 7/1993 | Wu et al. . | |
| 5,247,746 | 9/1993 | Johnson et al. . | |
| 5,323,589 | 6/1994 | Linner . | |
| 5,334,405 | 8/1994 | Gorlich . | |
| 5,348,752 | 9/1994 | Gorlich . | |
| 5,371,998 | 12/1994 | Johnson et al. . | |
| 5,417,255 | 5/1995 | Sanfilippo et al. . | |
| 5,419,096 | 5/1995 | Gorlich . | |
| 5,419,097 | 5/1995 | Gorlich et al. . | |
| 5,419,101 | 5/1995 | Gorlich et al. . | |
| 5,439,132 | 8/1995 | Gorlich . | |
| 5,447,736 | 9/1995 | Gorlich . | |
| 5,452,563 | 9/1995 | Marano et al. . | |
| 5,473,860 | 12/1995 | Linner . | |
| 5,479,759 | 1/1996 | Gorlich et al. . | |
| 5,486,383 | 1/1996 | Nowotarski et al. . | |
| 5,488,811 | 2/1996 | Wang et al. . | |
| 5,509,252 | 4/1996 | Gorlich . | |
| 5,529,178 | 6/1996 | Gorlich . | |
| 5,534,282 | 7/1996 | Garwood . | |
| 5,617,705 | 4/1997 | Sanfilippo et al. | 53/432 |
| 5,816,024 | 10/1998 | Sanfilippo et al. | 53/432 |

75
76
78
80
82
84
90
91
16
49
50
51
52
53
54
55
W
X
Y
Z
V

CONTROLLED ENVIRONMENT SEALING APPARATUS AND METHOD

FIELD OF THE INVENTION

The invention generally relates to a tray sealing apparatus used in sealing plastic film to product filled containers. More specifically the invention relates to an apparatus and method for exposing containers filled with product, including, for example, food product and any product that has an adverse reaction to air, to a controlled environment during the sealing operation.

BACKGROUND OF THE INVENTION

Various products including food product, and any other product that has an adverse reaction to air, are packaged in a controlled environment. Various attempts have been made to efficiently package these products in a modified atmosphere using vacuum and/or controlled environment.

Various food products, including bakery goods, meats, fruits, vegetables, etc. are packaged under atmospheric conditions. Many of these products are presented in supermarkets, for example, in cartons or cardboard containers with a plastic or cellophane wrap covering the product.

One problem with this type of packaging is that the goods have a minimum limited shelf life, which for many products are only several days to a week. With bakery goods, for example, mold may begin to grow after a few days under atmospheric conditions. Such products obviously cannot be sold or consumed and must be discarded.

Another problem arises with respect to many fruits and vegetables, which continue to ripen and continue their metabolic process under atmospheric conditions. For example, within a few days a banana can become overripe and undesirable to the consumer.

The space available for gassing and sealing operations is often limited at many facilities. In general, existing controlled environment sealing systems are often expensive, bulky, and require use of vacuum pumps, and, accordingly are impractical for use at many of these facilities.

In an effort to alleviate these problems, various attempts have been made to package food in a controlled environment by injecting controlled environment directly into filled containers. A high velocity flow is often necessary to penetrate into the food product. In general, these attempts have proved unsuccessful. With bakery goods, for example, the high velocity jets may pull in air and re-contaminate the product, thereby failing to reduce the oxygen to levels that would prevent the normal onset of mold.

Various techniques for removing air in food filling processes are known in the art. Such processes are used, for example, in the packaging of nuts, coffee, powdered milk, cheese puffs, infant formula and various other dry foods. Typically, dry food containers are exposed to a controlled environment gas flush and/or vacuum for a period of time, subsequent to filling but prior to sealing. The product may also be flushed with a controlled environment gas prior to filling, or may be flushed after the filling process. When the oxygen has been substantially removed from the food contents therein, the containers are sealed, with or without vacuum. Various techniques are also known for replacing the atmosphere of packaged meat products with a modified atmosphere of carbon dioxide, oxygen and nitrogen, and/or other gases or mixtures of gases to extend shelf life.

Many existing modified atmosphere tray sealing systems use an indexing conveyer to allow the tray and product to enter into a vacuum chamber and be exposed to reduced pressure, and then sealed within the vacuum chamber. In some applications, inert gas is used to back flush as the pressure is returned to atmospheric. The tray may then be permanently sealed with plastic film, which is heat sealed to the tray flange with a vertically reciprocating seal bar.

One drawback to these existing systems is that the vacuum chambers may be expensive to operate and take up additional space on the line. Other drawbacks in rapid vacuum applications include pulling product into the seal area causing leakers, as well as, the necessity that the lidstock or film must be extra wide to cover the entire chamber, increasing overall scrap. It would be desirable to have a controlled environment tray sealing system for use with a non-continuous or indexing conveyer system and vertically reciprocating tray sealers that would efficiently seal product within trays.

SUMMARY OF THE INVENTION

One aspect of the invention provides a controlled environment sealing apparatus comprising a reciprocating seal head positioned above a conveyer carrying product-filled trays, a film feeder to dispense film between the tray and the reciprocating seal head, and at least one seal head gassing assembly positioned in the seal head and oriented to direct a flow of controlled environment gas through a cut-out portion of the film into a product-filled tray positioned beneath the seal head. The seal head gassing assembly may preferably direct a high velocity controlled environment gas stream surrounded by a lower velocity controlled environment gas stream downward into the tray positioned below the seal head. A programmable controller may preferably be used to control the timing of the high velocity and low velocity gas flow through the seal head gassing assembly. Preferably, the seal head gassing assembly includes a housing including a low velocity gas inlet opening and a high velocity gas inlet opening. The housing may preferably include a body and a cap with the inlet openings formed in the cap. A flow guide member is preferably positioned in the body of the housing. The flow guide member preferably includes a low velocity flow opening to communicate with the low velocity gas inlet opening, and includes a high velocity flow opening to communicate with the high velocity gas inlet opening. The high velocity flow opening of the flow guide member is preferably slotted and communicates with a centrally located high velocity gas orifice, which extends through the flow guide member. A distribution member may preferably be positioned within the body of the housing and below the flow guide member. The distribution member may preferably include a spout and at least one opening formed therein and surrounding the spout. The spout preferably communicates with the high velocity gas flow and the distribution member opening communicates with the low velocity gas flow. Preferably, the distribution member includes a plurality of openings formed therein and surrounding the spout. A baffle may preferably be positioned between the flow guide member and the distribution member. A gassing element may preferably be positioned in a bottom portion of the housing body. A second gassing element may preferably be positioned in a bottom portion of the housing body. The second gassing element is preferably in contact with the first gassing element to allow a dual laminarized flow of controlled environment gas to exit from the housing body. Preferably the conveyer may be a shuttle plate including two tray openings.

A further aspect of the invention provides a method of operating a controlled environment sealing apparatus. A reciprocating seal head positioned above an intermittent conveyer carrying product-filled trays is provided. At least one seal head gassing assembly is positioned in the seal head. A film feeder to dispense film is also provided. A product-filled tray is conveyed to a position below the seal head. A gas stream is flowed through a cut-out portion of a film dispensed through a film feeder into the product-filled tray positioned beneath the seal head. Preferably, a high velocity stream of controlled environment gas is flowed through the seal head gassing assembly. A low velocity stream of controlled environment gas may also simultaneously be flowed through the seal head gassing assembly. Preferably, the high velocity stream is stopped prior to advancing film from the film feeder. The seal head is preferably next moved downward to seal the film against a flange portion of the tray. As the seal head is moved upward, a top portion of the film is contacted by a simultaneous flow of high velocity gas. A programmable controller may be used to program a timing sequence to synchronize the high velocity and low velocity gas flow with the conveyer movement, the film advancement and the seal head actuation. Depending on the size of the tray being gassed, a plurality of seal head gassing elements may be positioned in the seal head and controlled environment gas flowed through the seal head gassing assemblies.

A further aspect of the invention provides a controlled environment sealing apparatus comprising a reciprocating seal head, and at least one seal head gassing assembly positioned in the seal head. The seal head gassing assembly includes a housing with a high velocity gas inlet opening and a low velocity gas inlet opening. A spout communicates with the high velocity gas flow, which is supplied through the high velocity gas inlet opening. At least one gassing element communicates with the low velocity flow exiting the seal head assembly, and the low velocity flow surrounds the high velocity flow exiting the seal head assembly. A plurality of seal head gassing assemblies may be positioned in the seal head. A plurality of gassing elements may preferably be positioned to surround the spout and provide a dual laminarized flow. Depending on the application, the seal head gassing assembly may be made of a high or low heat conductive material.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
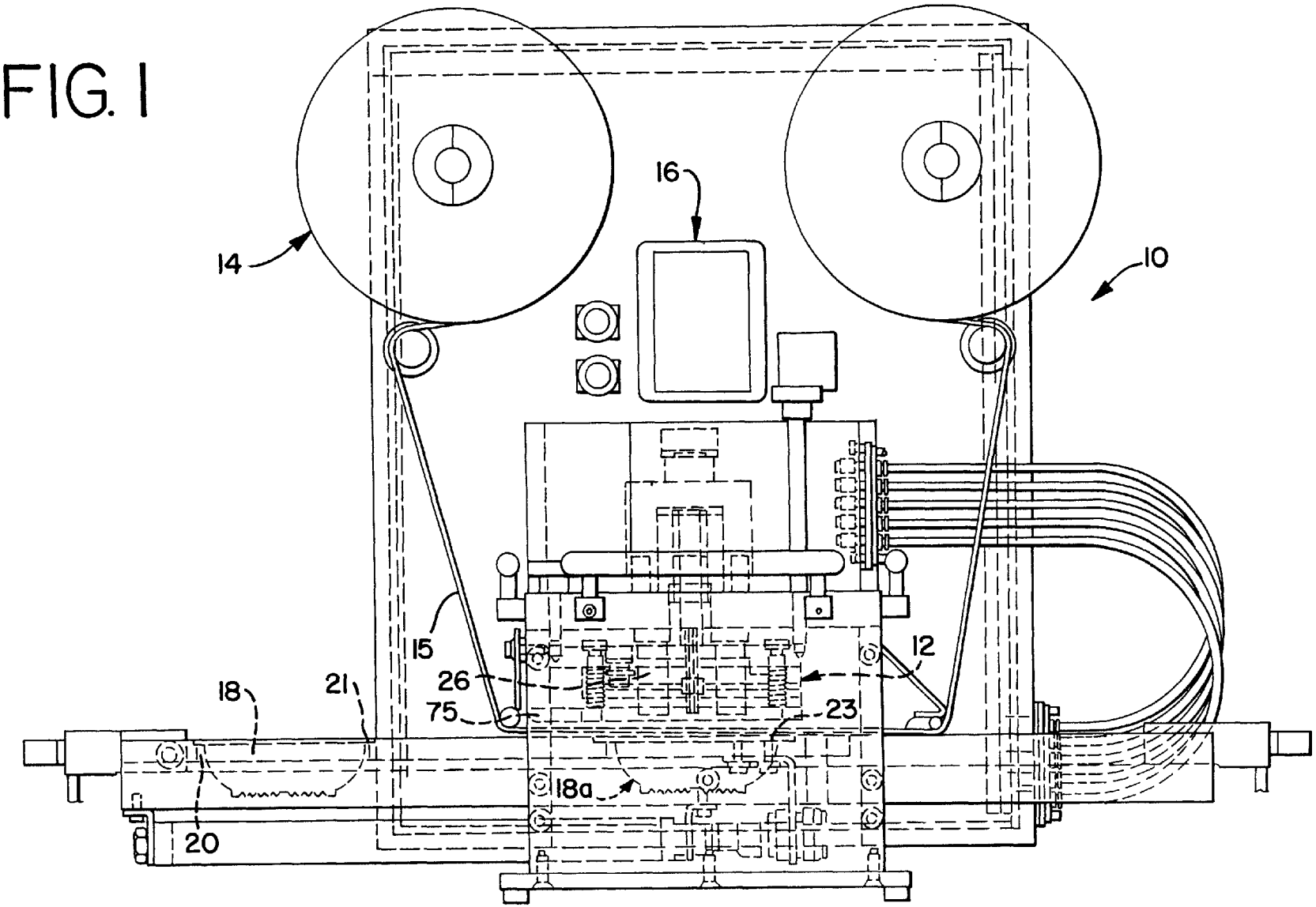
FIG. 1 is a side elevational view of a preferred embodiment of a controlled environment sealing apparatus made in accordance with the invention.
Figure 2:
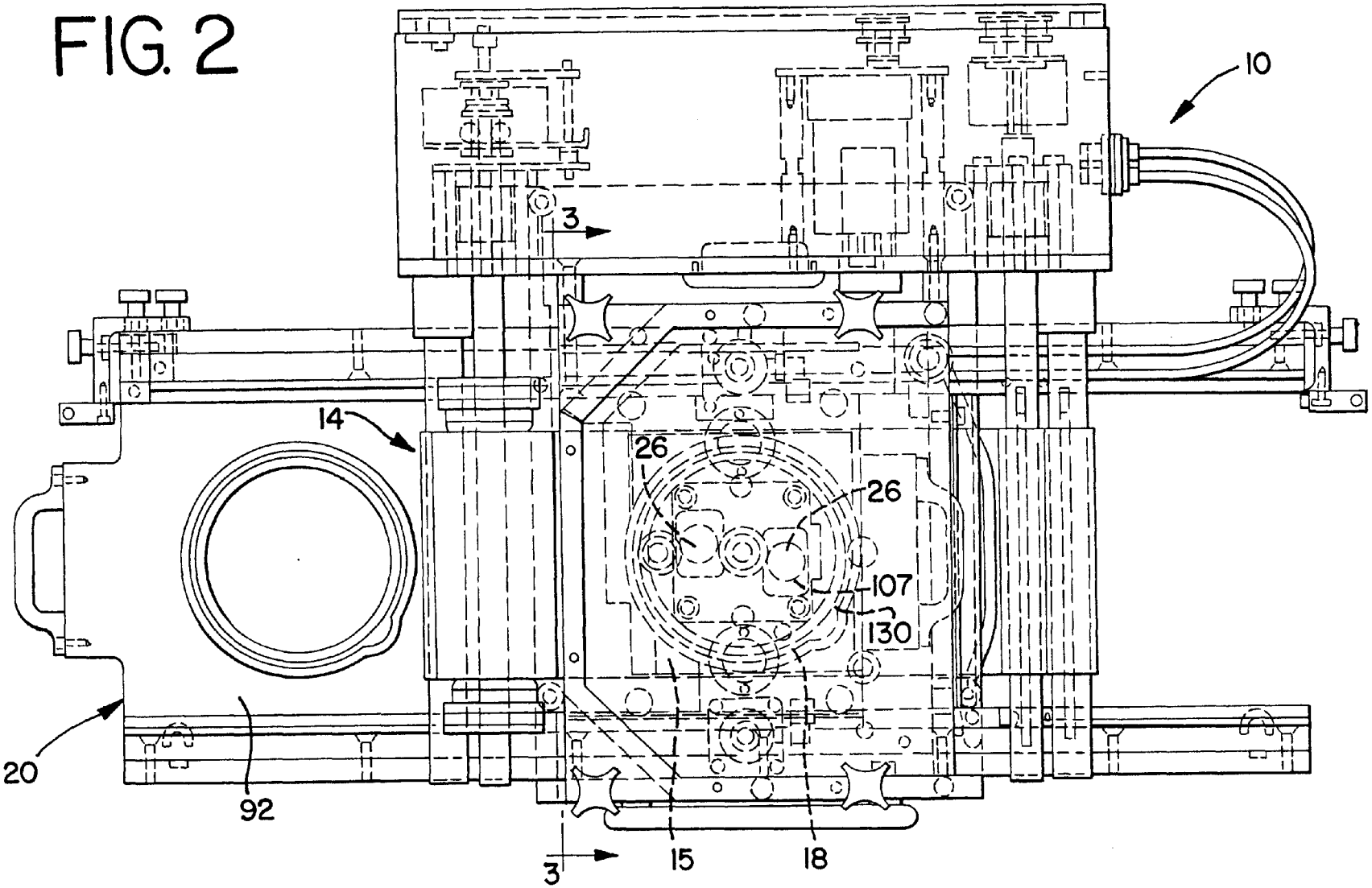
FIG. 2 is a plan view of the embodiment of FIG. 1 with the seal head, film cut-out and tray shown in phantom.

Referring to FIGS. 1–5, a preferred embodiment of a controlled environment sealing apparatus is generally shown at 10. The sealing apparatus 10 generally includes a tray sealer 12, a film feeder 14 and a programmable controller 16. Trays 18 filled with food product travel along conveyer 20 to position the trays 18 beneath the tray sealer 12. The tray sealer 12 preferably includes a seal head assembly 22, which receives one or more seal head gassing assemblies 26. Controlled environment gas is preferably flowed through the seal head gassing assemblies 26 and through a cut-out portion 130 of the film 15 into the tray 18.

The conveyer 20 may preferably be a manually operated shuttle plate which includes two openings 21, 23 for receiving trays 18, 18*a*. While one tray 18*a* is being gassed and sealed beneath the seal head assembly the operator may remove the sealed tray and insert a new food-filled tray 18. As described in U.S. patent application Ser. No. 08/886,963, the entire disclosure of which is incorporated herein by reference, the conveyer 20 may alternatively be an intermittent conveyer and the trays 18 are preferably flushed with controlled environment gas using stationary and/or reciprocating gassing rails prior to entering the seal station. Controlled environment gas may include, for example, inert gas, combinations of gases and other aromas, mists, moisture, etc. used in providing a controlled environment within the sealed trays 18.

Figure 3:
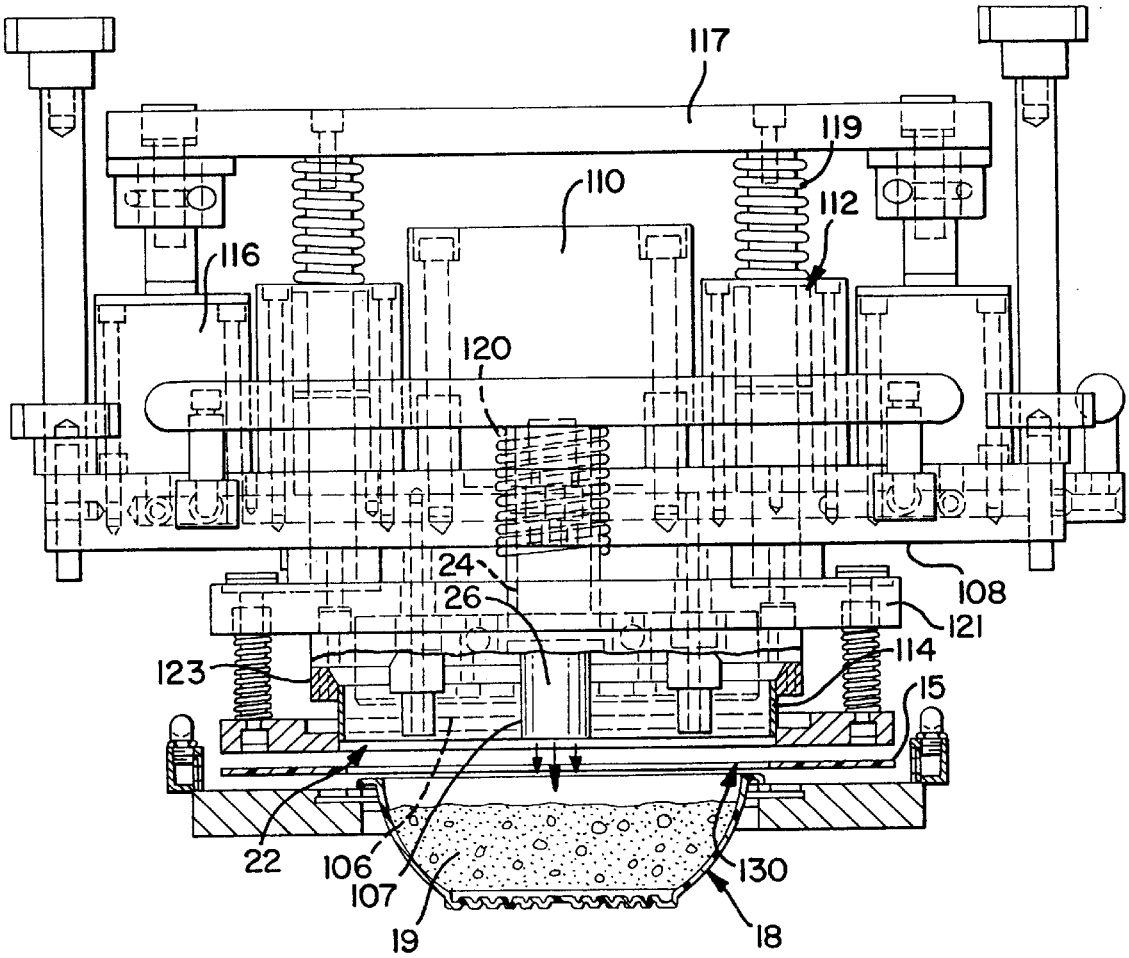
FIG. 3 is an enlarged sectional view taken through line 3—3 of FIG. 2 in the up position.
Figure 4:
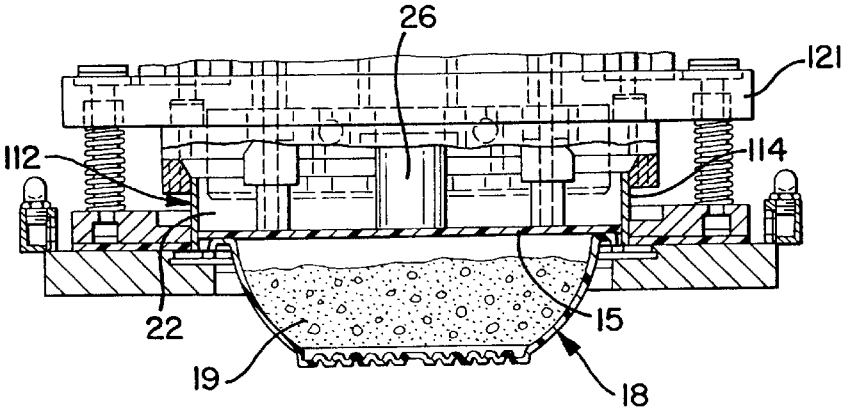
FIG. 4 is a partial sectional view of FIG. 3 in the down position.

Referring to FIG. 3, the seal head assembly 22 may preferably include a seal head 106, mounting plate 108, air cylinder 110 seal head bushing 24, and spring 120. A knife assembly 112 may preferably include knife 114, knife cylinders 116, knife cross-bar 117, return spring 119, knife base plate 121 and knife frame 123. The seal head 106 preferably includes openings 107 to receive the seal head gassing assemblies 26. The seal head spring 120 may be provided to hold up the seal head during power shut down.

Figure 6:
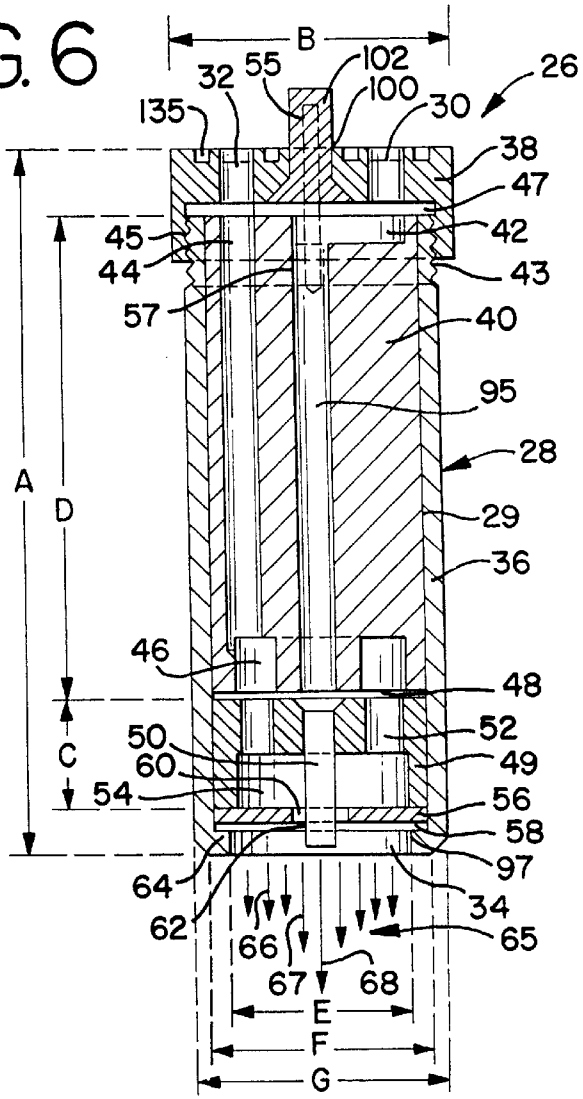
FIG. 6 is a preferred embodiment of a seal head gassing member made in accordance with the invention.

Referring to FIG. 6, the seal head gassing assembly 26 preferably includes an outer housing 28 including a high velocity gas inlet opening 30, a low velocity gas inlet opening 32, and a manifold opening 34. Preferably, the housing 28 includes a body 36 and a cap 38. The housing body 36 and cap 38 may preferably be made of a rigid durable material. The housing body 36 may preferably have a cylindrical shape. The gas inlet openings 30, 32 are preferably formed through the cap 38. The housing body 36 includes an inner chamber 29, and the manifold opening 34 is formed through a bottom portion of the body 36. The housing body 36 preferably includes an upper threaded portion 43, which receives a threaded portion 45 of cap 38. A gasket 47 is preferably positioned within the cap 38 to allow the cap 38 to securely seal with the body 36 to prevent gas leakage. The cap 38 also preferably includes a guide pin 55 (shown in phantom) which extends through the cap 38 and is received in a locator opening 57 formed in a flow guide member 40. The location pin 55 aids in aligning the inlet openings 30, 32 with the openings formed in the flow guide member 40. The cap 38 also includes O-rings 135 which surround inlet openings 30, 32 and allows high velocity and low velocity controlled environment gas supply lines to be securely attached to the seal head gassing assembly 26.

Referring to FIG. 6, the flow guide member 40, which may also be preferably cylindrical-shaped slidably fits within the chamber 29 formed in the housing body 36. The flow guide member 40 may also preferably be made of a rigid durable material. The flow guide member 40 preferably includes high velocity flow opening 42, which is slotted to communicate with a centrally located high velocity flow orifice 95. Controlled environment gas at high velocities is supplied through high velocity gas opening 30 and flows into high velocity flow opening 42 and through the high velocity flow orifice 95 which extends through the length of flow guide member 40. The flow guide member 40 also preferably includes a low velocity flow opening 44 which communicates at an upper end with low velocity gas opening 32 and communicates at its lower end with a recessed area 46 formed in a bottom portion of the flow guide member 40.

The high and low velocity gas preferably flows through baffle 48. The baffle 48 is preferably circular-shaped and has a diameter approximately the same as an inner diameter of the housing body 36. The baffle 48 may preferably be made of 5-ply, 75 micron stainless steel mesh. Positioned beneath the baffle 48 is a distribution member 49, which preferably includes a center spout 50 which channels the high velocity flow through the seal head gassing assembly 26.

Figures 7, 8, 9, 10, 11:
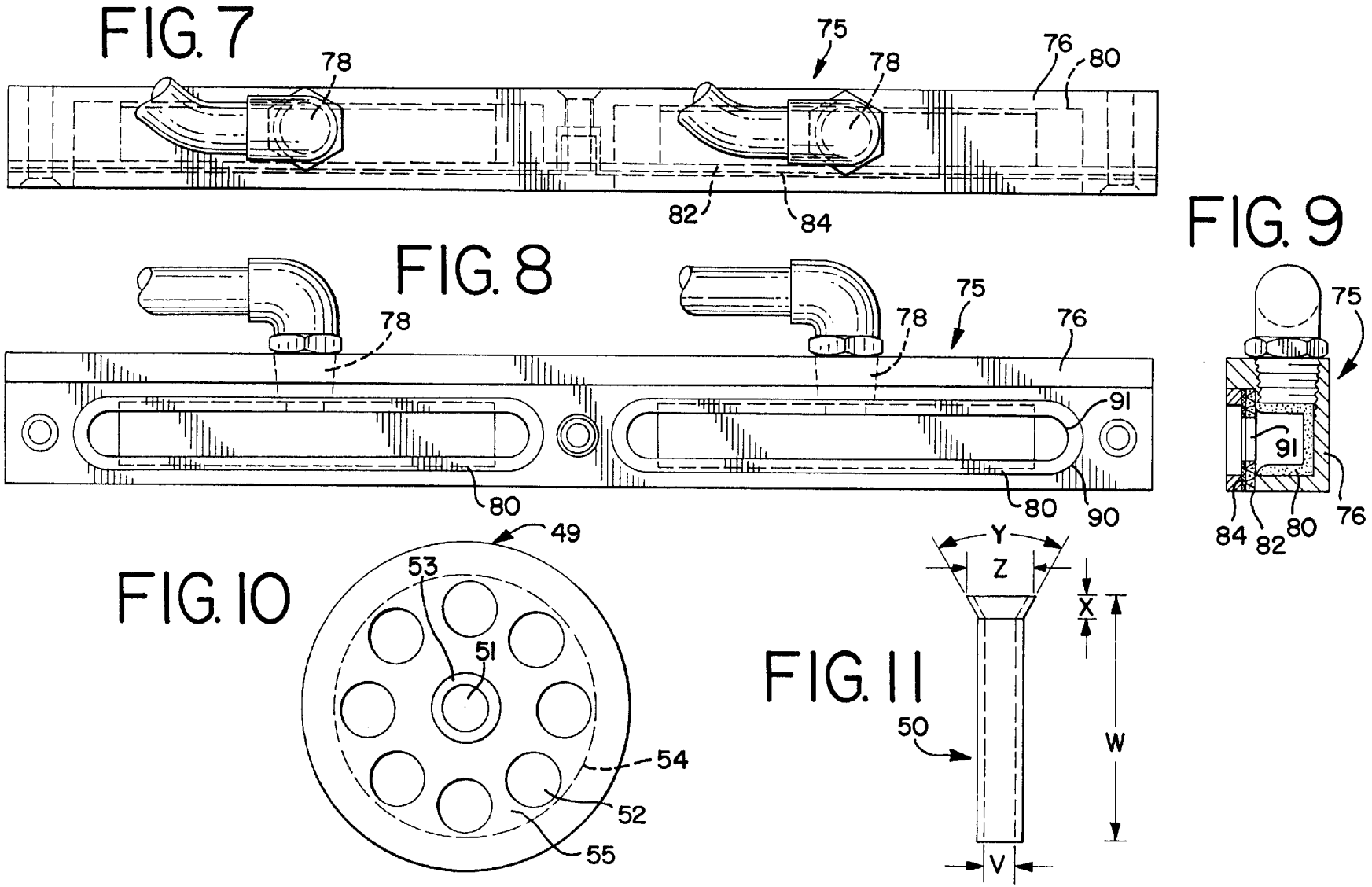
FIG. 7 is a top view of a preferred embodiment of a seal station side gassing rail.
FIG. 8 is a side view of the embodiment of FIG. 7.
FIG. 9 is a sectional view of the embodiment of FIG. 8.
FIG. 10 is a top view of a preferred embodiment of the distribution member.
FIG. 11 is a side view of a preferred embodiment of the spout.

As shown in FIGS. 6 and 10 the distribution member 49 may also preferably include a plurality of distribution openings 52 which receive low velocity gas flow and channel the flow into a recessed area 54 formed in a bottom portion of the distribution member 49. The distribution member 49 may also preferably be made of a rigid, durable material. The distribution openings 52 are positioned to channel the low velocity flow around the centrally located spout 50. The distribution openings 52 are preferably equally spaced and encircle the spout 50. One or more elongated slots may alternatively be used in place of the distribution openings 52. As shown in FIGS. 6, 10 and 11, the distribution member 49 may preferably have a 0.938 inch diameter to allow it to slidably fit within the chamber 29 of housing body 36. The distribution member 49 preferably includes an opening 51 with chamfered edge 53 to receive spout 50. In the embodiment, shown the distribution openings 52 may have a 0.156 inch diameter and are spaced on a 0.563 inch diameter circle 55 (shown in phantom). The opening 51 may have a 0.1285 inch inner diameter and 0.192 inch outer diameter. The spout 50 may, for the embodiment shown, include the following dimensions: V=0.055 inch, W=0.674 inch, X=0.058 inch, Y=60 degrees, and Z=0.192 inch.

Figure 5:
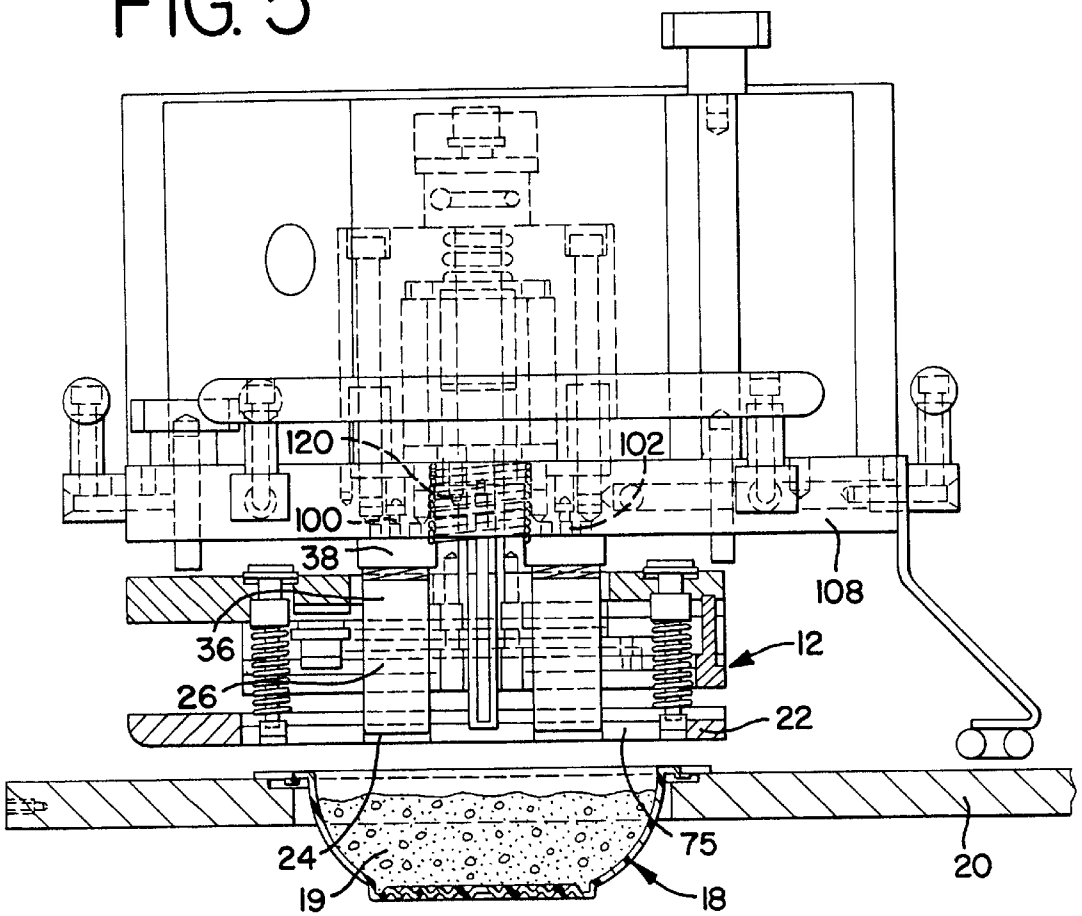
FIG. 5 is an enlarged partial side elevational of the embodiment of FIG. 1.

In the embodiment of FIG. 6, the seal head gassing assembly 26 may include, for example, the following dimensions: A=3.222 inches, B=1.251 inch dia., C=0.50 inch, D=2.232 inches, E=0.813 inch dia., F=0.957 inch dia., and G=1.125 inch dia. The seal head gassing assembly 26 is designed for quick removal and disassembly for cleaning purposes. An opening 100 is preferably formed in cap 38 to receive a flat head cap screw 102. Referring to FIG. 5, the cap screw 102 is received in an opening 104 formed in a plate portion 108 of the seal head assembly 22. A notch 97 may be formed in the bottom of the body 36 to allow an operator to quickly remove the seal head gassing assembly 26 with a wrench.

Referring to FIG. 6, the low velocity flow exits the distribution member 49, it most preferably flows through a top gassing element 56 and a bottom gassing element 58, which are positioned to surround the spout 50. The top gassing element 56 may preferably be made of a 5-ply stainless steel wire screen having a hole size of between about 10–100 microns. The top gassing element 56 preferably has an opening 60, which has a diameter larger than the diameter of the spout 50. The bottom gassing element 58 may preferably include an opening 62 formed therein which preferably is substantially the same size as the outer diameter of the spout 50 to allow the spout 50 to pass through the opening 62. The bottom gassing element 58 may preferably be made of a 2-ply stainless steel screen having a hole size of about 80 microns. The top gassing element 56 and bottom gassing element 58 both preferably have a circular-shape with a diameter substantially the same as the inner diameter of the housing body 36. A perimeter region of the bottom gassing element 58 preferably contacts with a retaining portion 64 of the housing body 36.

As shown in FIG. 6, the spout 50 preferably does not extend below the housing body 36 to avoid damages to the spout 50 during handling and/or other operations. The top and bottom gassing elements 56, 58 may preferably be positioned to provide a dual laminarized flow, which completely surrounds the accelerated or high velocity flow 68 exiting the spout 50. The gas stream from the spout 50 is preferably in the range of, for example, 100–1100 ft./sec., or from 100 ft./sec. up to sonic speeds (speed of sound). The high velocity flow 68 is designed to impinge upon the product 19 within the tray 18. The high velocity flow 68 will preferably penetrate into the product 19 to replace air entrapped within and around the product 19. The lower velocity and preferably laminarized flow surrounding the high velocity flow 68 substantially prevents outside air from being pulled into the tray 18 and/or product 19.

Referring to FIG. 6, a preferred flow profile 65 of controlled environment gas exiting the seal head gassing assembly 26 includes a first or outer region of flow 66 having the lowest velocity (indicated by arrows) because the controlled environment gas passes through both the top and bottom gassing elements 56, 58. Preferably, an inner or second region of flow 67 passes through only the bottom gassing element 58 and has a slightly higher flow velocity. The high velocity flow 68 exiting the spout 50 is accordingly surrounded by the outer region 66 and inner region 67 of flow. Various other flow profiles, which provide for a lower velocity flow 66 surrounding a high velocity flow 68, may also alternatively be created by altering the number of gassing elements and openings formed in the gassing elements. For example, the opening 62 in the bottom screen 58 may alternatively be made slightly larger than the outer diameter of spout 50 to allow a slightly higher velocity than the second region and provide a tri-laminarized flow. In a preferred embodiment, for example, the outer diameter of the spout 50 is 0.125 inch and the opening 62 in the bottom screen is 0.156 inch.

Referring to FIGS. 1–5, the programmable controller 16 may be programmed to time the preferred sealing operation. The programmable controller 16 may be any of a number of commercially available computers and/or logic controllers. The programmable controller 16 may be used to independently control the conveyer 20, film feeder 14, which are preferably servo-driven. The programmable controller 16 is also used to program the timing of supply of high and low velocity gas to the seal head gassing assemblies 26. Once the tray 18 is indexed forward on the conveyer 20 to the sealing station and positioned beneath the seal head assembly 22, high and low velocity controlled environment gas is timed to flow through the seal head gassing assemblies 26, through the cut-out 130 of the film 15, and into the tray 18. The film feeder 14 may preferably be synchronized with the gassing and conveyer movement. The controlled environment gas is preferably flowed through a cut-out portion of the film 15, which was created when the previous tray was sealed and the film cut with a knife which slides within a clamping plate located on tray sealer 12. Prior to the film advance, the high velocity gas is preferably turned off. The low velocity and/or laminarized flow may preferably continue to assure that the head space of the tray 18 is repurged to acceptable levels. The low velocity flow may be programmed to remain on while the film 15 is advanced, and may be timed to turn off when the film 15 is directly above and covering the tray opening 18. Alternatively, the low velocity flow may remain on throughout the sealing process.

As shown in FIGS. 7–9, side gassing rails 75 may preferably be used to provide a blanket of laminarized controlled environment gas flow into and around the tray 18 to assure that the tray 18 and its contents 19 are not re-contaminated during the sealing process. The side gassing rails 75 are preferably made of stainless steel and/or plastic, for example, Delrin. The side rails 75 preferably includes a housing 76, controlled environment gas inlets 78, distribution baffle 80, and thick gassing element 82 and thin gassing element 84. The gassing elements 82 and 84 are configured to provide a dual laminar flow. The distribution baffle 80 is preferably made of a 5-ply, 75-micron stainless steel mesh screen. The thick gassing element 82 is preferably made of a 5-ply, 75-micron stainless steel mesh screen, and the thin gassing element 84 is preferably made of a 2-ply, 80 micron stainless steel mesh screen. The baffle 80 and gassing elements 82, 84 are longitudinally positioned along manifold opening 90. Thick element 82 includes an elongated slot 91 formed therein to provide a dual laminarized flow through the gassing elements 82, 84. As shown in FIG. 5, the side rails 75 are preferably positioned parallel to the conveyer 20, on both sides of the conveyer 20 and aligned with the tray sealer 12. The face of the manifold opening 90 may be substantially perpendicular to the top face of the carrier plate 92. In the embodiment shown, the gassing rails 75 have two manifold openings 90. The rail 75 may have a length of, for example, 10.0 inches.

During the heat sealing process, the side gassing rails 75 may be programmed with the programmable controller 16 to turn off. Once the tray 18 is sealed, it is indexed forward and the next tray is gassed using the seal head gassing assemblies 26 through the cut-out area of the film 15. After gassing, the film 15 is advanced. This sequenced gassing and film feed operation allows for efficient purging operation of the trays 18 and is an efficient use of space.

During the sealing operation, the seal head 106 may be in the down or seal position for approximately ½–1½ seconds to effect a hermetic seal. The up stroke of the seal head 106 may take 150–200 milliseconds, which may tend to draw or create a partial vacuum and pull the tray from the conveyer 20 and/or carrier plate 92. The programmable controller 16 may be programmed to deliver a burst of high velocity gas through the spout 50 just prior to the up stroke to cause a positive pressure and ensure that the tray 18 is not dislodged out of the carrier plate 92, which may disrupt the packaging operation by breaking the film 15.

In sealing a variety of food products, for example, corn chips, oxygen levels of less than 1 percent have been consistently achieved with seal cycle times of approximately 6 seconds using the controlled environment sealing apparatus 10.

The seal head gassing assembly 26 may be configured differently for various applications. The seal head 106 preferably includes a cal rod to heat the seal head 106. In applications where it is desired to produce a negative pressure within the tray 18, the seal head gassing assembly components, including the cap 38, body 36, flow guide member 40, and distribution member 49 may preferably be made of a material having low heat conductivity properties, including, for example, stainless steel or plastic. This allows the heat from the seal head to be transferred to the seal head gassing assembly 26 to heat the gassing elements 56, 58. The gassing elements 56, 58, will, in turn, heat the controlled environment gas passing through the gassing elements. In applications where heated gas is not desired, the cap 38, body 36, flow guide member 40, and distribution member 49 may be made of a material having higher heat conductivity properties, including, for example, aluminum to keep the gassing elements cooler.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A controlled environment sealing apparatus comprising:

a reciprocating seal head positioned above a conveyer carrying product-filled trays;

a film feeder to dispense film between the tray and the reciprocating seal head; and at least one seal head gassing assembly positioned in the seal head and oriented to direct a flow of controlled environment gas through a cut-out portion of the film into a product-filled tray positioned beneath the seal head.

2. The apparatus of claim 1 wherein the seal head gassing assembly directs a high velocity controlled environment gas stream surrounded by a lower velocity controlled environment gas stream downward into the tray positioned below the seal head.

3. The apparatus of claim 2 further comprising a programmable controller to control the timing of the high velocity and low velocity gas flow through the seal head gassing assembly.

4. The apparatus of claim 1 wherein the seal head gassing assembly includes a housing including a low velocity gas inlet opening and a high velocity gas inlet opening formed therein.

5. The apparatus of claim 4 wherein the housing includes a body and a cap, the low velocity and high velocity inlet openings formed in the cap.

6. The apparatus of claim 5 further comprising a flow guide member positioned in the body of the housing, the flow guide member including a low velocity flow opening to communicate with the low velocity gas inlet opening, and including a high velocity flow opening to communicate with the high velocity gas inlet opening.

7. The apparatus of claim 6 wherein, the high velocity flow opening of the flow guide member is a slotted opening that communicates with a centrally located high velocity gas orifice which extends through the flow guide member.

8. The apparatus of claim 6 further comprising a distribution member positioned within the body of the housing and below the flow guide member, the distribution member including a spout and at least one opening formed therein and surrounding the spout, the spout communicating with a high velocity gas flow, the distribution member opening communicating with a low velocity gas flow.

9. The apparatus of claim 8 wherein the distribution member includes a plurality of openings formed therein and surrounding the spout.

10. The apparatus of claim 8 further comprising a baffle positioned between the flow guide member and the distribution member.

11. The apparatus of claim 10 further comprising a gassing element positioned in a bottom portion of the housing body.

12. The apparatus of claim 11 further comprising a second gassing element in contact with the first gassing element to allow a dual laminarized flow of controlled environment gas to exit from the housing body.

13. The apparatus of claim 1 wherein the conveyer is a shuttle plate including two tray openings.

14. A method of operating a controlled environment sealing apparatus comprising:

providing a reciprocating seal head positioned above an intermittent conveyer carrying product-filled trays, at least one seal head gassing assembly positioned in the seal head; and a film feeder;

conveying a product-filled tray to a position below the seal head; and flowing a gas stream simultaneously through a cut-out portion of a film dispensed from the film feeder into the product-filled tray positioned beneath the seal head.

15. The method of claim 14 further comprising:

flowing a high velocity stream of controlled environment gas through the seal head gassing assembly; and flowing a low velocity stream of controlled environment gas through the seal head gassing assembly.

16. The method of claim 15 further comprising:

stopping the high velocity stream prior to advancing film from the film feeder.

17. The method of claim 16 further comprising:

moving the seal head downward to seal the film against a flange portion of the tray.

18. The method of claim 17 further comprising:

moving the seal head upward while simultaneously flowing high velocity gas against a top portion of the film.

19. The method of claim 15 further comprising:

providing a programmable controller; and programming a timing sequence to synchronize the high velocity and low velocity gas flows with the conveyer movement and film advancement.

20. The method of claim 19 further comprising programming the timing sequence to further synchronize seal head actuation.

21. The method of claim 14 further comprising a plurality of seal head gassing elements positioned in the seal head, flowing controlled environment gas through the seal head gassing assemblies.

* * * * *